US008418994B2

(12) United States Patent
Ko et al.

(10) Patent No.: US 8,418,994 B2
(45) Date of Patent: Apr. 16, 2013

(54) HOT-COLD INLET PIPE STRUCTURE

(75) Inventors: Hsi Chia Ko, Changhua County (TW); Jui Feng Ko, Changhua County (TW)

(73) Assignee: Chung Cheng Faucet Co., Ltd, Changhwa County (TW)

( * ) Notice: Subject to any disclaimer, the term of this patent is extended or adjusted under 35 U.S.C. 154(b) by 534 days.

(21) Appl. No.: 12/714,505

(22) Filed: Feb. 28, 2010

(65) Prior Publication Data

US 2011/0209793 A1 Sep. 1, 2011

(51) Int. Cl.
*F16L 29/00* (2006.01)

(52) U.S. Cl.
USPC ..... 251/152; 251/148

(58) Field of Classification Search ..... 251/148, 251/151, 152; 137/606, 625.41; 138/108, 138/114, 115
See application file for complete search history.

(56) References Cited

U.S. PATENT DOCUMENTS

| | | | | |
|---|---|---|---|---|
| 277,427 | A | | 5/1883 | Recht |
| 552,315 | A | | 12/1895 | Connelly |
| 639,010 | A | | 12/1899 | Barthels |
| 673,971 | A | | 5/1901 | Bartliff |
| 779,896 | A | | 1/1905 | Wood, Jr. |
| 1,248,099 | A | | 11/1917 | Finnigan |
| 1,738,915 | A | | 12/1929 | Mueller |
| 1,742,793 | A | | 1/1930 | Staples |
| 2,165,621 | A | | 7/1939 | Donahue et al. |
| 2,249,469 | A | | 7/1941 | Gray et al. |
| 2,485,960 | A | | 10/1949 | Donahue |
| 3,387,309 | A | | 6/1968 | Johnson |
| 3,762,173 | A | | 10/1973 | Marsh |
| 3,770,004 | A | | 11/1973 | Johnson et al. |
| 3,778,090 | A | | 12/1973 | Tobin |
| 3,885,298 | A | | 5/1975 | Pogonowski |
| 3,938,240 | A | | 2/1976 | Holden |
| 4,064,900 | A | | 12/1977 | Schmitt |
| 4,142,843 | A | | 3/1979 | Kish |
| 4,316,318 | A | | 2/1982 | Mineo |
| 4,334,703 | A | | 6/1982 | Arthur et al. |
| 4,484,600 | A | | 11/1984 | Peterson et al. |
| 4,700,736 | A | | 10/1987 | Sheen |
| 4,739,523 | A | | 4/1988 | Bondar |
| 5,195,553 | A | | 3/1993 | Wright |
| 5,494,259 | A | | 2/1996 | Peterson |
| 5,642,755 | A | | 7/1997 | Mark et al. |
| 5,718,464 | A | | 2/1998 | Mark |
| 5,865,473 | A | * | 2/1999 | Semchuck et al. ..... 285/55 |
| 6,161,230 | A | | 12/2000 | Pitsch |

* cited by examiner

*Primary Examiner* — John K Fristoe, Jr.
*Assistant Examiner* — Reinaldo Sanchez-Medina
(74) *Attorney, Agent, or Firm* — CHI IP Law Firm

(57) ABSTRACT

An improved hot-cold inlet pipe structure includes an external-threaded pipe and an internal pipe forming an integrated piping structure. The internal pipe extends outwardly a wrapping section that covers a plurality of threaded openings of the external pipe. The internal pipe is composed of non-toxic materials that include plastic materials that are high resistance to pressure and climate change. The internal pipe also reduces the use of metallic materials and does not release of toxic chemical to water stream. A depressed section of the interior of a top of end of the inlet pipe includes a receiving chamber, the receiving chamber includes an opening that includes numerous slots. The slots receive a control valve unit such that the slots mesh with the control valve unit. This design is also beneficial in the manufacturing of the inlet pipe.

7 Claims, 25 Drawing Sheets

HOT-COLD INLET PIPE STRUCTURE

BACKGROUND OF THE INVENTION

1. Field of the Invention

Embodiments of the invention generally relate to an improvement on hot-cold water inlet pipe structure. This design uses an external-threaded pipe and an inner pipe to form an integrated inlet pipe. This design further improves strength of raw materials, as well as lowers usage of metallic raw materials. The inner pipe also includes a receiving groove and a corresponding inlet ring to prevent leakage. At the same time, aspects of the invention decrease the complicated process of assembly, which also improve the application of the invention.

2. Background of the Invention

According to previous technology, such as a hot-cold water inlet pipe 10 shown in FIG. 1, the pipe 10 includes a metallic inlet pipe 11 with a control valve 13 and a valve base 12. The inlet pipe 11 includes an internally threaded section 111 on one side. At a distal end of the threaded section 111, a stopping end 112 is threaded. Also, the valve base 12 includes a stopping ring 121 with a diameter that is larger than a diameter of a secondary pipe 122. The secondary pipe 122 is fitted with a seepage ring 123. During assembly, the secondary pipe 122 of the valve base 12 is inserted into the inlet pipe 11 such that the threaded section 111 meshes with that of the secondary pipe 122 and the seepage ring 123. In addition, as the secondary pipe 122 and the inlet pipe 11 is tightened, the stopping end 112 is biased against the stopping ring 121 of the valve base 12 to further generate the bonding between the two pipes.

However, based on the above design of the prior technology, there are a few shortcomings. For example, (1) in order for the inlet pipe 11 and the valve base 12 to be tightened through the meshing of the secondary pipe 122, the seepage ring 123, and the threaded section 111 to prevent seepage or leakage, external forces are needed to wind the pipes along the threads to prevent water seepage or leakage. This is a labor intensive work and is time consuming. (2) The inlet pipe 11 is subjected to water pressure over an extended period of time and, in order to extend the life of the inlet pipe 11, the overall thickness of the pipe wall of the inlet pipe 11 may be increased. As such, metallic materials are used, which further increase the cost of manufacturing. (3) Also, the inlet pipe 11 and the valve base 12 are separate and independent pieces

BRIEF SUMMARY OF THE INVENTION

Aspects of the invention overcome shortcomings of prior technologies by introducing an external-threaded pipe with an internal pipe forming an integrated design of a hot-cold water inlet pipe. This design of the inner pipe provides the overall water pressure resistance of the inlet pipe as well as decreases the cost of metallic materials in the raw material.

Embodiments of the invention also use this design to eliminate the intricate structures of the pipes in prior technologies. The integrated design of the invention further eliminates the need to exert external forces for the purpose of tightening the connections of different piping and for the purpose of preventing leakage or seepage. This configuration is advantageous to installing of embodiments of the invention. Additional advantageous to embodiments of the invention is to reduce the manufacturing cost associated therewith. Further advantages include the use of non-toxic materials, including high-pressure resistance and sever-climate resistance plastic materials, for the internal or inner pipe. This configuration reduces the exposure of the water in the pipe to the metallic external-threaded pipe, which prevents water pollution of the water due to metallic elements of lead, zinc, copper, arsenic, etc.

This summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Other features will be in part apparent and in part pointed out hereinafter.

BRIEF DESCRIPTION OF THE DRAWINGS

Corresponding reference characters indicate corresponding parts throughout the drawings.

DETAILED DESCRIPTION OF THE INVENTION

Figure 1:
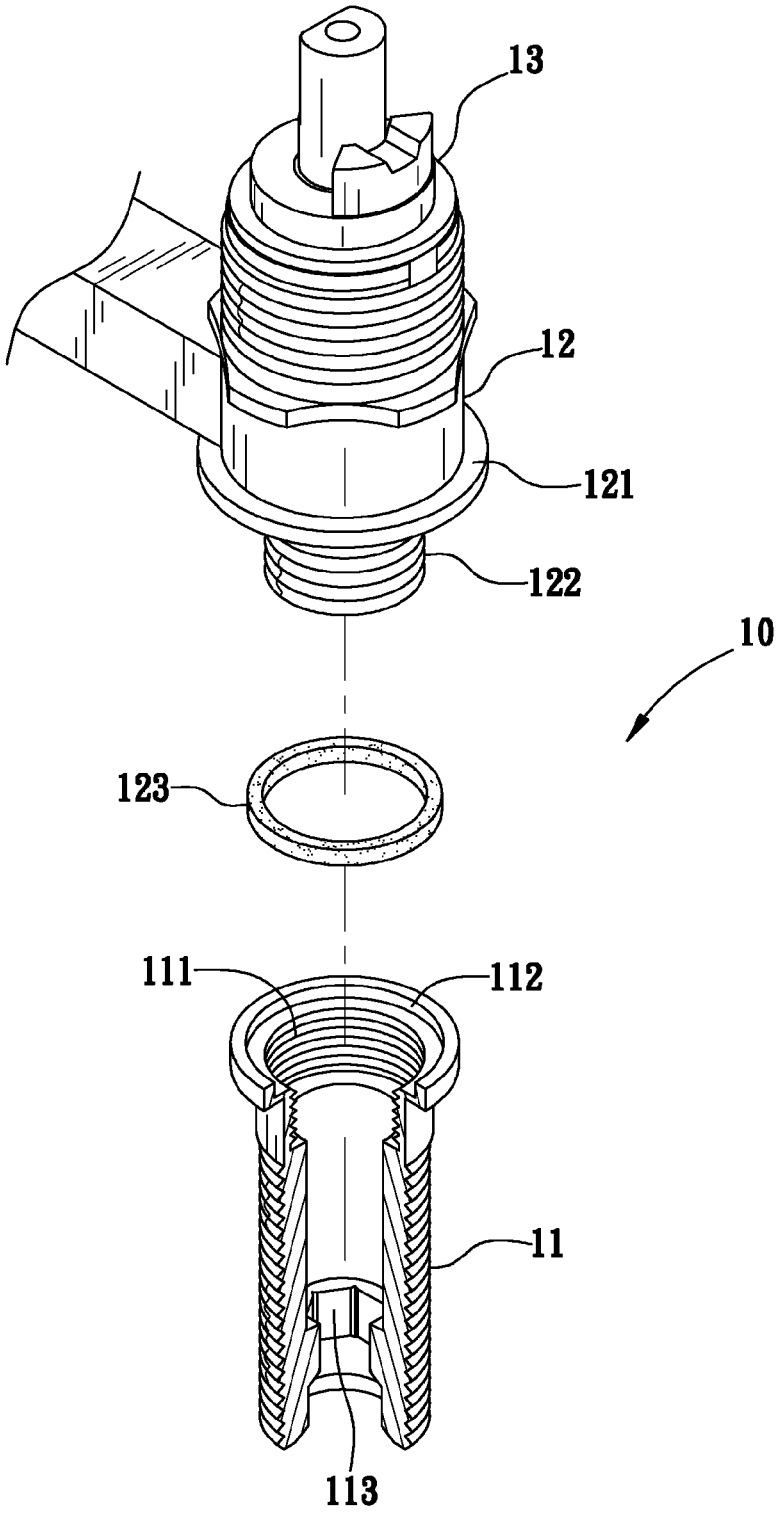
FIG. 1 Prior art
FIG. 1 is a perspective view of a prior art.
Figure 2:
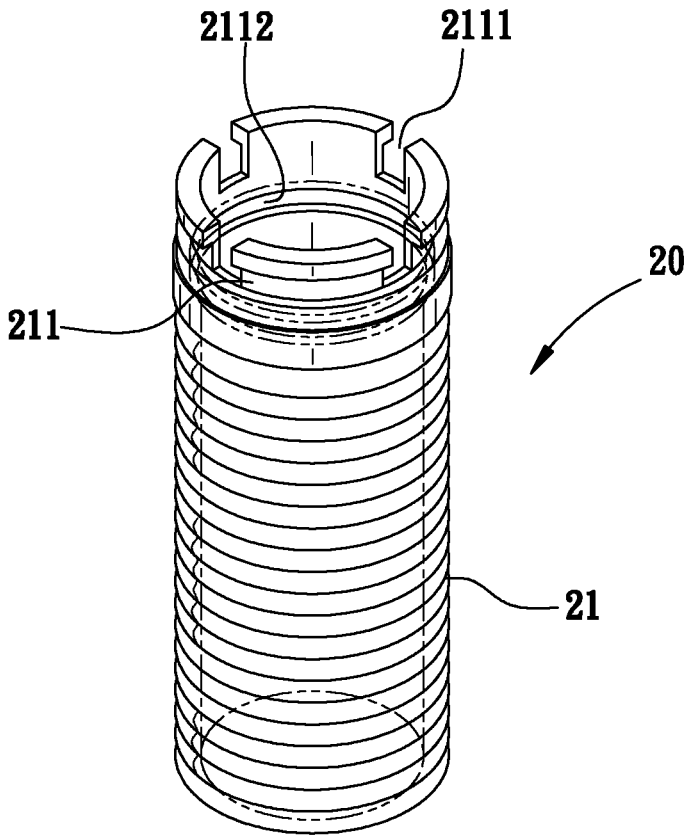
FIG. 2 is a perspective view of an external pipe according to one embodiment of the invention.
Figure 2A:
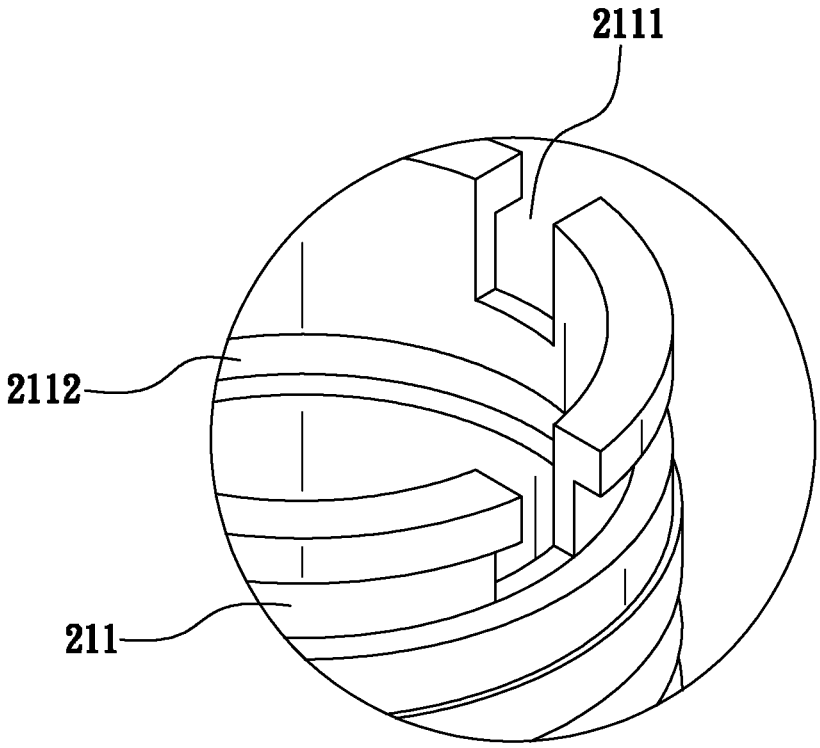
FIG. 2A is a magnified view of a part of the external pipe of FIG. 2 according to an embodiment of the invention.
Figure 3:
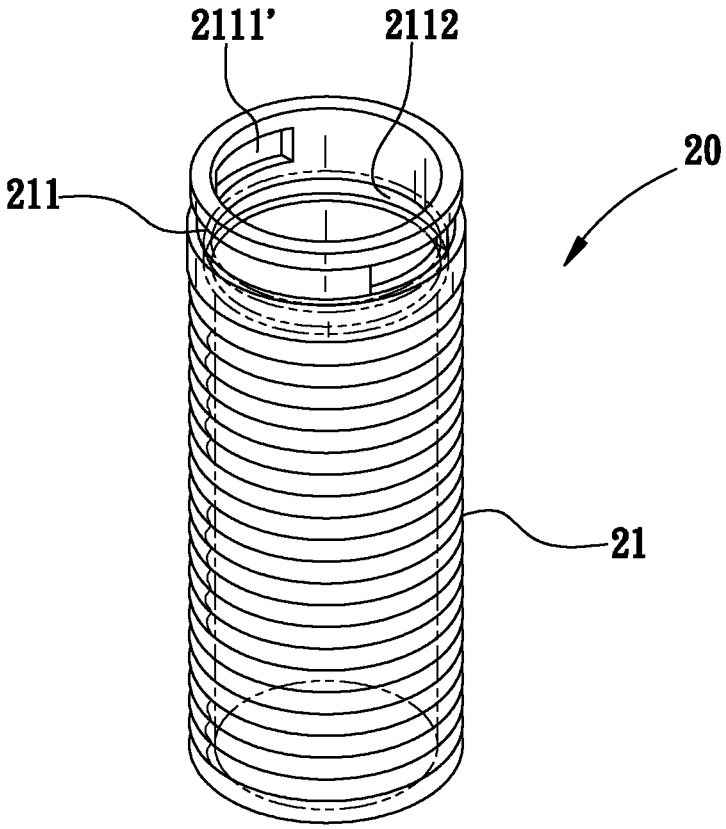
FIG. 3 is a perspective view of an external pipe according to another embodiment of the invention.
Figure 4:
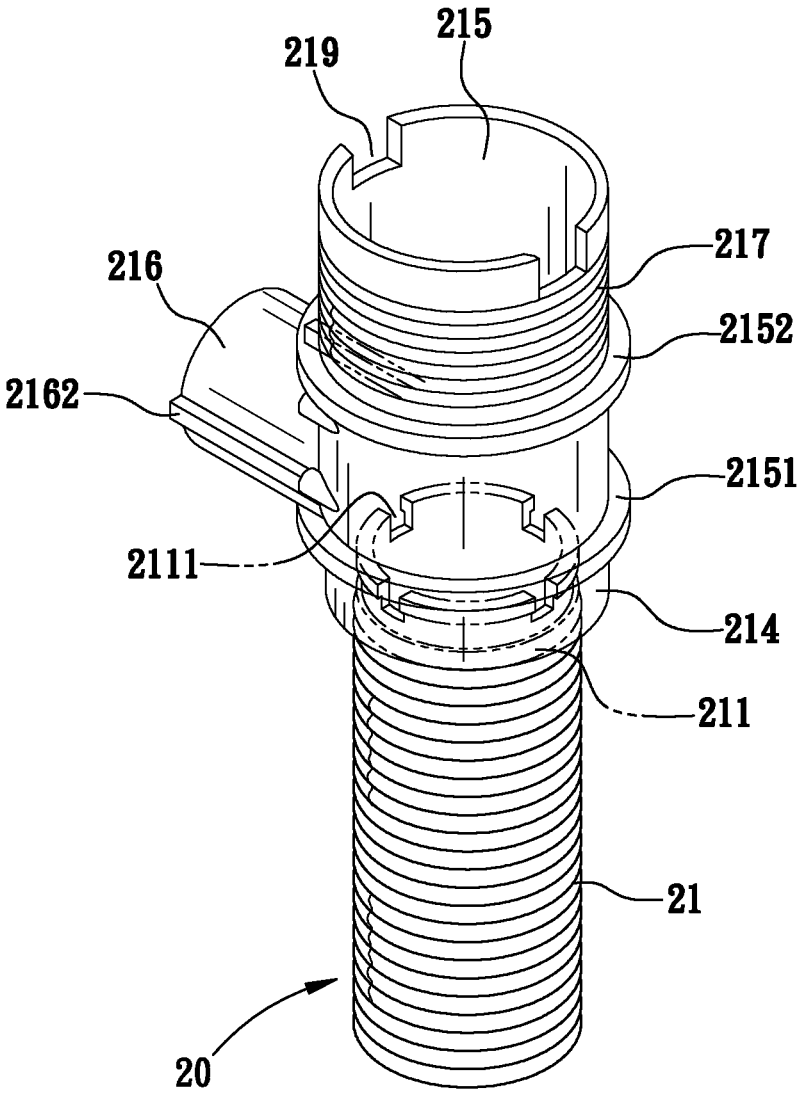
FIG. 4 is a perspective view of an inlet pipe according to an embodiment of the invention.
Figure 5:
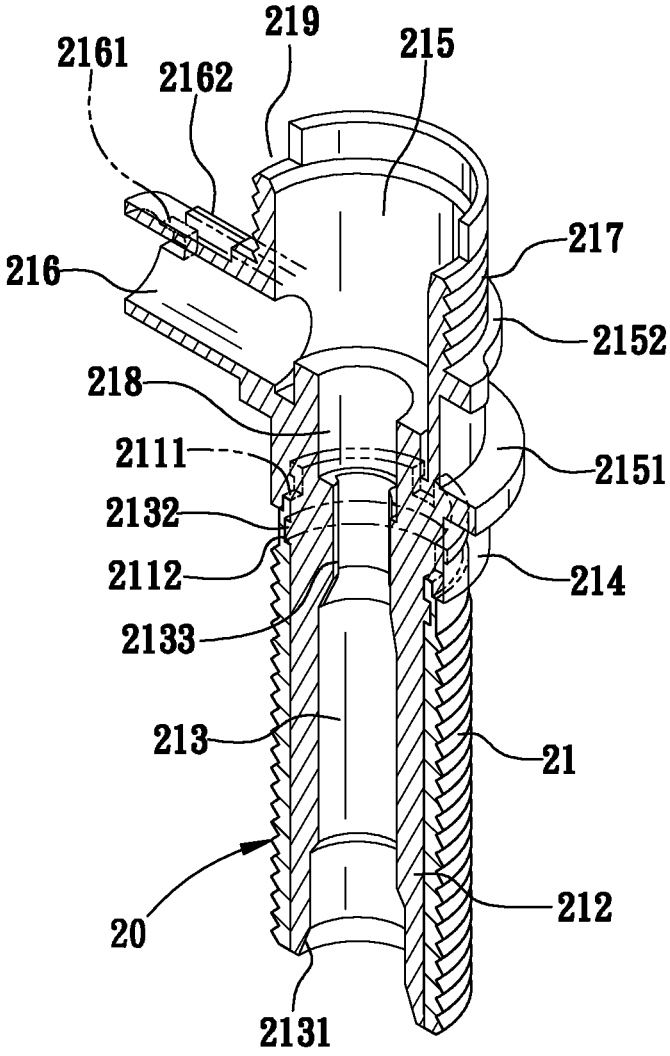
FIG. 5 is a perspective cross-section view of an inlet pipe according to an embodiment of the invention.
Figure 6:
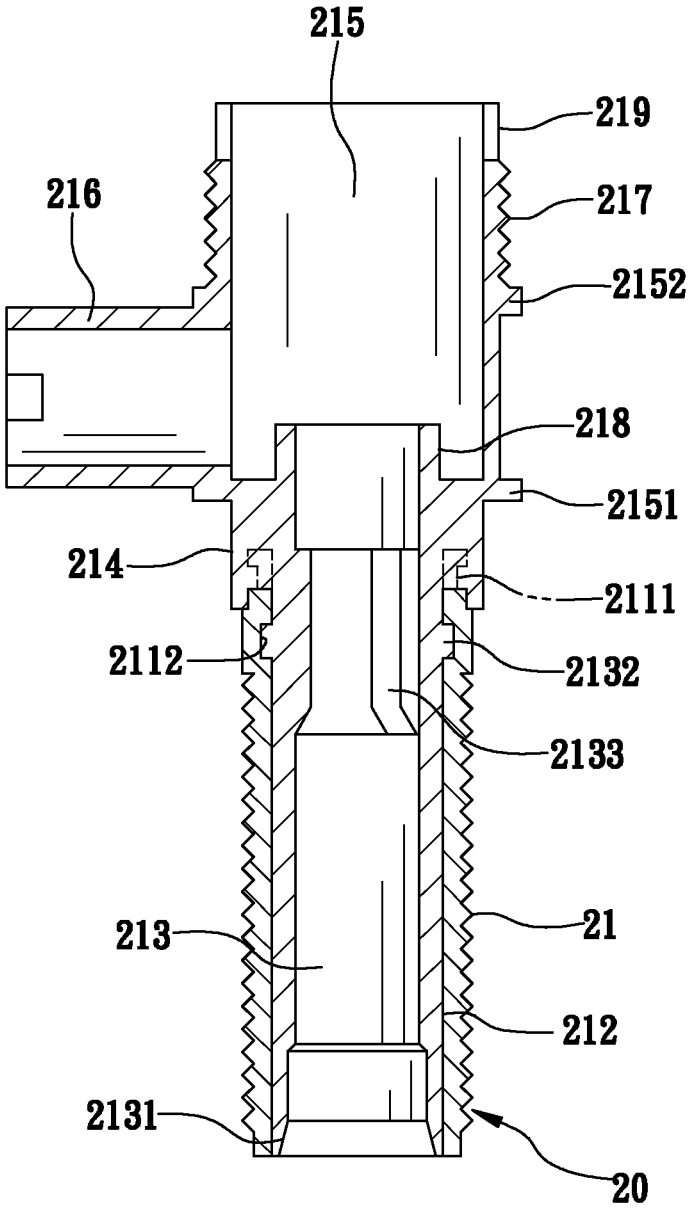
FIG. 6 is a cross-section view of the inlet pipe according to FIG. 5.

The following list shows reference characters used through FIGS. 1-24:

20 and 20'—an inlet pipe;
21—an external-threaded pipe;
211—a locking ring;
2111 and 2111'—a slit;
2112—a ring groove;
212—an inner wall;
213 and 213'—an internal pipe;
2131 and 2131'—a corner;
2132 and 2132'—a protruding ring;
2133 and 2133'—a strengthen band;
214 and 214'—a connecting section;
215—a receiving chamber;
2151—a first stopping ring;
2152—a second stopping ring;
215'—a cap;
215"—a water-receiving area;
2151'—a stopping ring;
2152'—a connecting base;
2153'—a first limiting slit;
216 and 216'—a pipe section;
2161—a second limiting slit;
2161'—a first strengthening rib;
2162—a second strengthening rib;
217—an external thread section;
218—a water-entry ring base;
2181—a stopping ring;
219—a locking slit;
30 and 30'—a control valve;
31'—a rotating axle;
40—an outlet pipe;
41—a connecting pipe;
411—a sealing ring;
42—a joining pipe;
50—a faucet outlet;
51—a protruding strengthening rib;
52—a limiting slit;
60—a first face plate;
61—a first handle;
62—a screw opening;
63—a locking unit;
40'—an outlet pipe;
41'—a lock connecting section;
42'—a connecting pipe;
43'—a fourth limiting slit;
44'—an outlet end;
50'—a faucet outlet;
60'—a second face plate;
61'—a limiting piece;
62'—a second handle;
40"—an outlet pipe;
41"—a ring thread;
411"—a sealing ring;
42"—an opening;
421'—a sealing ring;
422'—a strengthening rib;
43"—an internal threaded section;
50"—a faucet outlet;
51"—a cap;
60"—a third face plate;
70 and 70'—an outlet connecting pipe;
71 and 71'—a connecting pipe;
711 and 711'—a sealing ring;
712'—a fifth strengthening rib;
72—a pipe section;
72'—a receiving chamber;
721'—a pre-set opening;
73—a receiving chamber;
731—a stopping ring;
74—an external threaded section;
75—a connecting section;
80—an outlet pipe;
81—a strengthening rib;
811—a limiting slit;
90 and 90'—a face plate;
901—a limiting piece;
901'—a limiting rib;
91—a handle;
92—a locking cover;
93'—an outlet.

Aspects of the invention may be practiced based on one or more embodiments, including preferred embodiments, below. For example, FIG. 2 through FIG. 6 describe aspects of the invention. For example, an inlet pipe 20 includes an external-threaded pipe 21. The pipe 21 is composed of a metallic material. A locking ring 211 is disposed at a distal end on an external surface of the external-threaded pipe 21. The locking ring 211 has a smaller diameter than that of the external-threaded pipe 21. One or more slits 2111 are formed on the locking ring 211 at the distal end of the external-threaded pipe 21. In one embodiment, the locking ring 211 is in the shape of a "reverse L". In another embodiment, the locking ring 211 includes one or more slits 2111' that are enclosed in the wall of the locking ring 211. The external-threaded pipe 21 includes an inner surface, and a ring groove 2112 is disposed at the inner surface near the opening end of the external-threaded pipe 21. The ring groove 2112 and an inner wall 212 of the external-threaded pipe 21 form a strengthening band 2133 to further assist the strength of an internal pipe 213. In one embodiment, the strengthening band 2133 may be a set of three or more. The internal pipe 213 includes a connecting section 214 disposed at a distal vertical end, and the connection section 214 has a larger diameter than that of the inner pipe 213. The connecting section 214 connects with the slit 2111 or 2111' such that the slit 2111 or 2111' is enclosed inside the connecting section 214 to form one integrated body. The internal pipe 213 includes a protruding ring 2132 that correspond to a ring groove 2112 that receives the protruding ring 2132 such that the protruding ring 2132 is fitted in the ring groove 2112 to further create resistance against pulling or pushing forces exerted on the inlet pipe 20. The internal pipe 213 is composed of non-toxic, climate resilient, and pressure resilient plastic material. A distal end, the opposite end to the protruding ring 2132, of the internal pipe 213 includes a corner 2131 at a slanted angle. The internal pipe 213 includes a receiving chamber 215 at the other distal end. The receiving chamber 215 includes a first stopping ring 2151 and a second stopping ring 2152 spaced apart at an outer surface thereof. A pipe section 216 is disposed between the first stopping ring 2151 and the second stopping ring 2152, and the pipe section 216 is connected with the receiving chamber 215. An opening of the pipe section 216 includes one or more second limiting slits with corresponding one or more second strengthening ribs to further strengthen the pipe section 216. An external groove section 217 is disposed above the second stopping ring 2152. A water-entry ring base 218 is disposed at an end of the receiving chamber 215 such that the receiving chamber 215 is connected with the internal pipe 213. At the other end opposite to that of the water-entry ring base 218 of the receiving chamber 215, one or more locking slits 219 connect with a control valve. As such, the slits 2111 or 2111' and the locking ring 211 enclose the connecting section 214 from all sides to form the integrated inlet pipe 20. This configuration reduces assembly of the inlet pipe 20 and increases production efficiency. In addition, the internal pipe 213 includes overall strength of the inlet pipe 20 and reduces the use of metallic material. Also, the water or fluid flowing in the pipe will not come in contact with the external-threaded pipe 21, which is of metallic material. This prevents water or fluid to include metallic elements, such as lead, zinc, copper, arsenic, etc., which reduces water quality.

Figure 7:
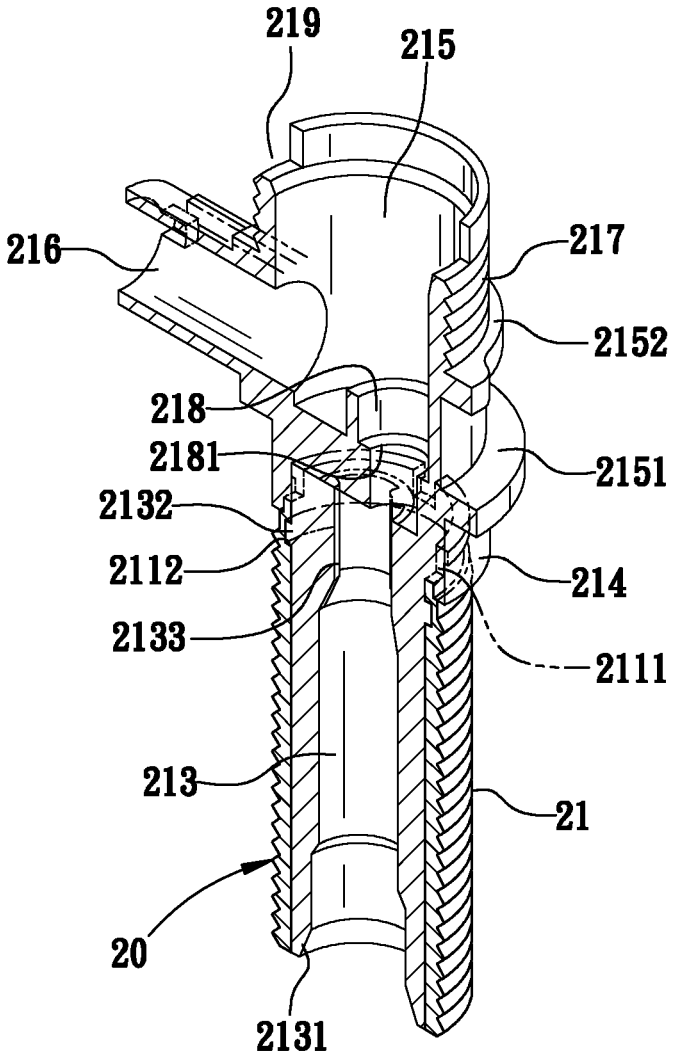
FIG. 7 is a perspective cross-sectional view of an inlet pipe according to another embodiment of the invention.
Figure 8:
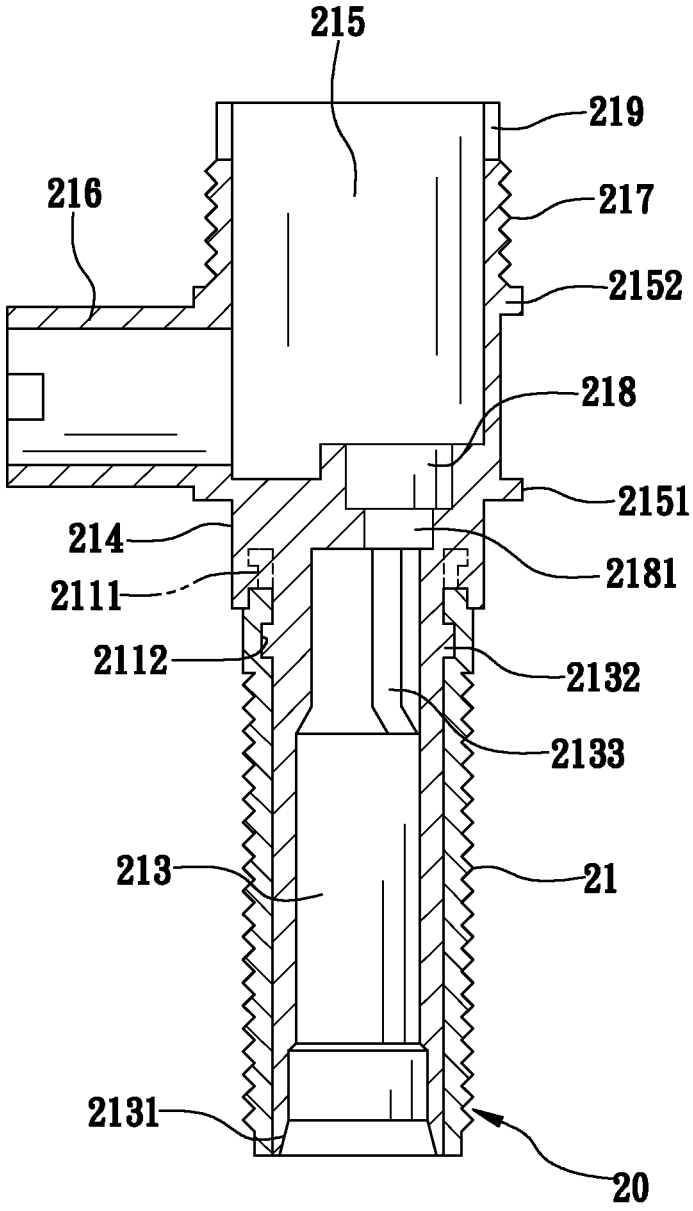
FIG. 8 is a cross-section view of the inlet pipe according to FIG. 7.

Also, as depicted in FIG. 7 and FIG. 8, the water-entry ring base 218 may be disposed at an off-centered position and include a stopping ring 2181 at its distal end. The stopping ring 2181 is protruding and has a smaller diameter than that of the water-entry ring base 218.

Figure 9:
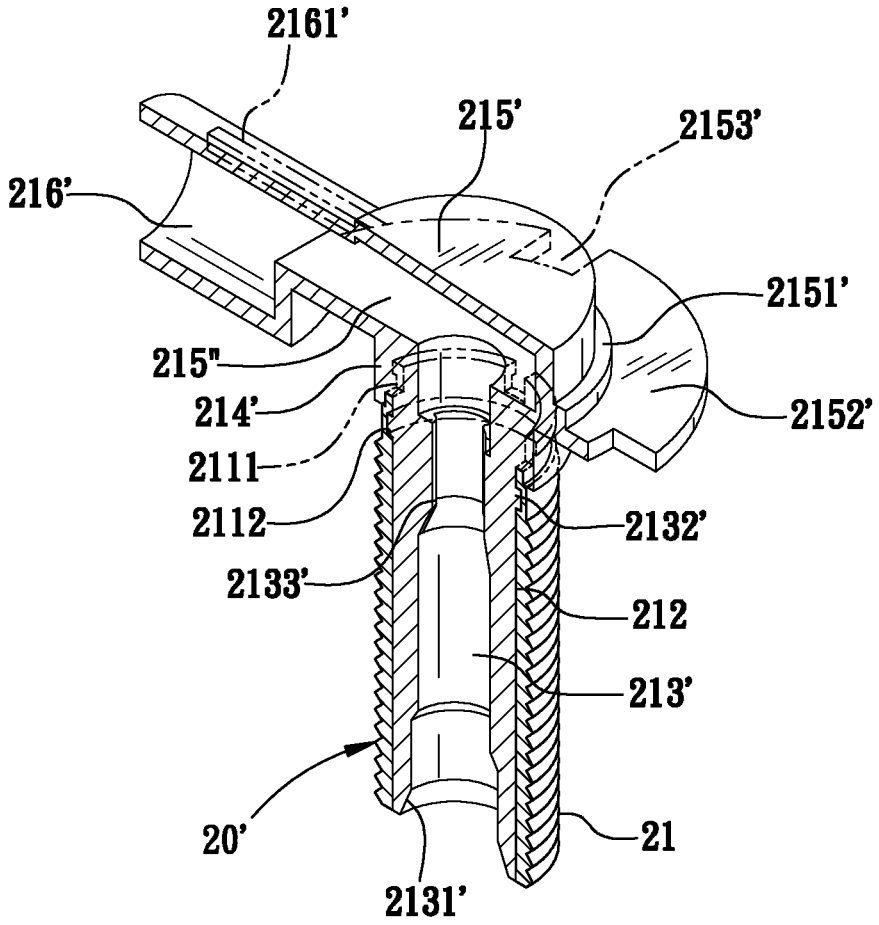
FIG. 9 is a perspective cross-section view of an inlet pipe according to a further embodiment of the invention.
Figure 10:
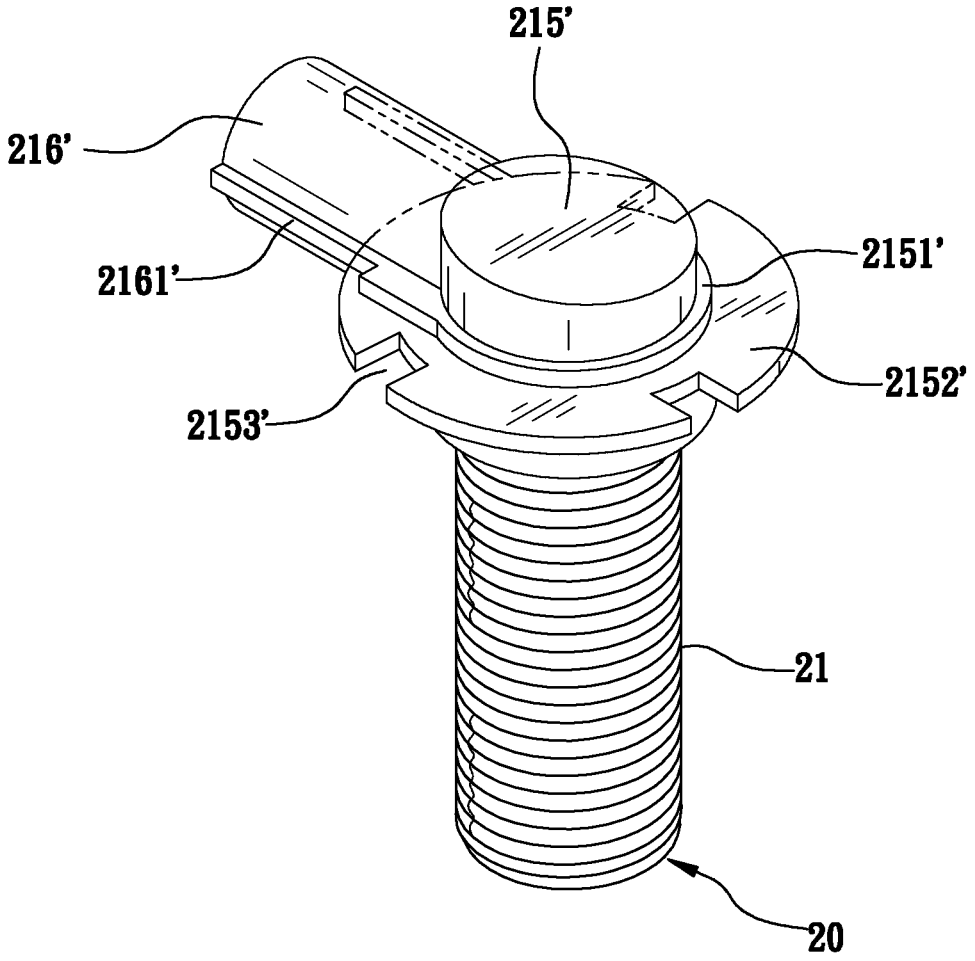
FIG. 10 is a perspective view of the inlet pipe of FIG. 9.

According to FIG. 9, another embodiment of the invention is also described (please also consult FIG. 10). The external-threaded pipe 21 includes an inner surface, and a ring groove 2112 is disposed at the inner surface near the opening end of the external-threaded pipe 21. The ring groove 2112 and an inner wall 212 of the external-threaded pipe 21 form a strengthening band 2133' to further assist the strength of an internal pipe 213'. In one embodiment, the strengthening band 2133' may be a set of three or more. For example, the description below is based on the strengthening band 2133' in a set of three. The internal pipe 213' includes a protruding ring 2132' that corresponds to or matches with the ring groove 2112. The protruding ring 2132' is locked or hooked within the ring groove 2112 in order to strengthen pulling or pushing forces exerted on the internal pipe 213'. The slit 2111' of the internal pipe 213' is set to be enclosed by a connecting section 214', and the connecting section 214' has a larger diameter than that of the inlet pipe 20' such that the slit 2111' and the connecting section 214' are formed as one unit. The internal pipe 213' is composed of a plastic material that is non-toxic with characteristics of pressure resistant and climate resistant. The distal end of the internal pipe 213' is designed to have a corner 2131' at a slanted angle. Extending upward vertically, a cap 215'may have a diameter that is larger than that of the inlet pipe 20' and forms a water-receiving area 215". The cap 215' includes a stopping ring 2151' on the exterior thereof and a connecting base 2152' that has a larger diameter than that of the cap 215'. In this embodiment, the cap 215' also includes a pipe section 216', and the pipe section 216' and the water-receiving area 215" and the internal pipe 213' are interconnected. The pipe section 216' includes a first strengthening rib 2161' disposed at an exterior surface of the pipe section 216' near its opening to help or assist the strengthen integrity of the pipe section 216'. In addition, the connecting base 2152' includes one or more first limiting slits on the edge of the connecting base 2152'. As such, the connecting section 214' may be completed surrounded and fixed at its position by the slit 2111 and the locking ring 211 such that the inlet pipe 20' is formed in one integrated piece such that the inlet pipe 20' reduces the need for complicated assembly and the cost of using metallic materials.

Figure 11:
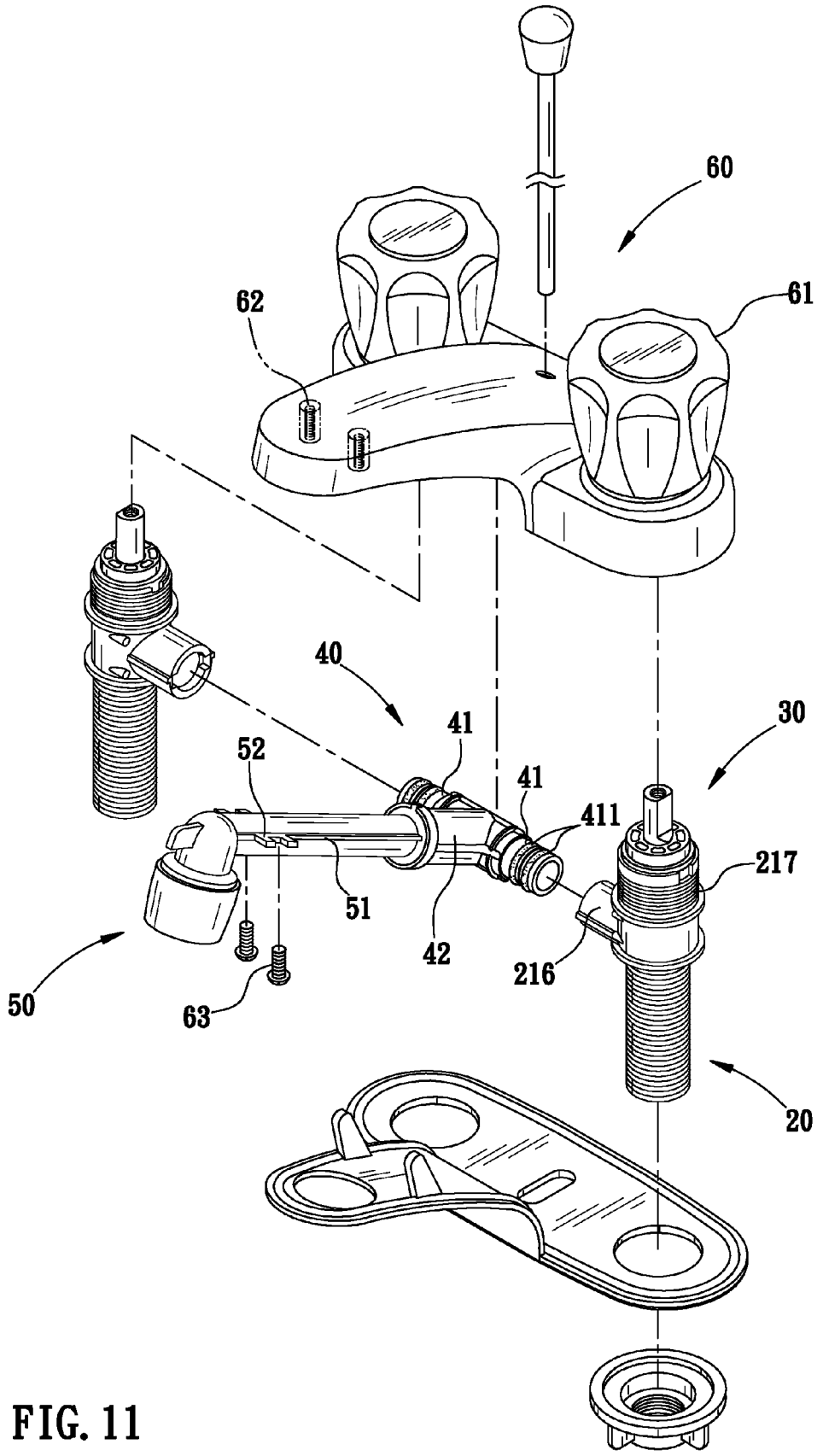
FIG. 11 is a perspective exploding view of the inlet pipe in an assembly according to one embodiment of the invention.
Figure 12:
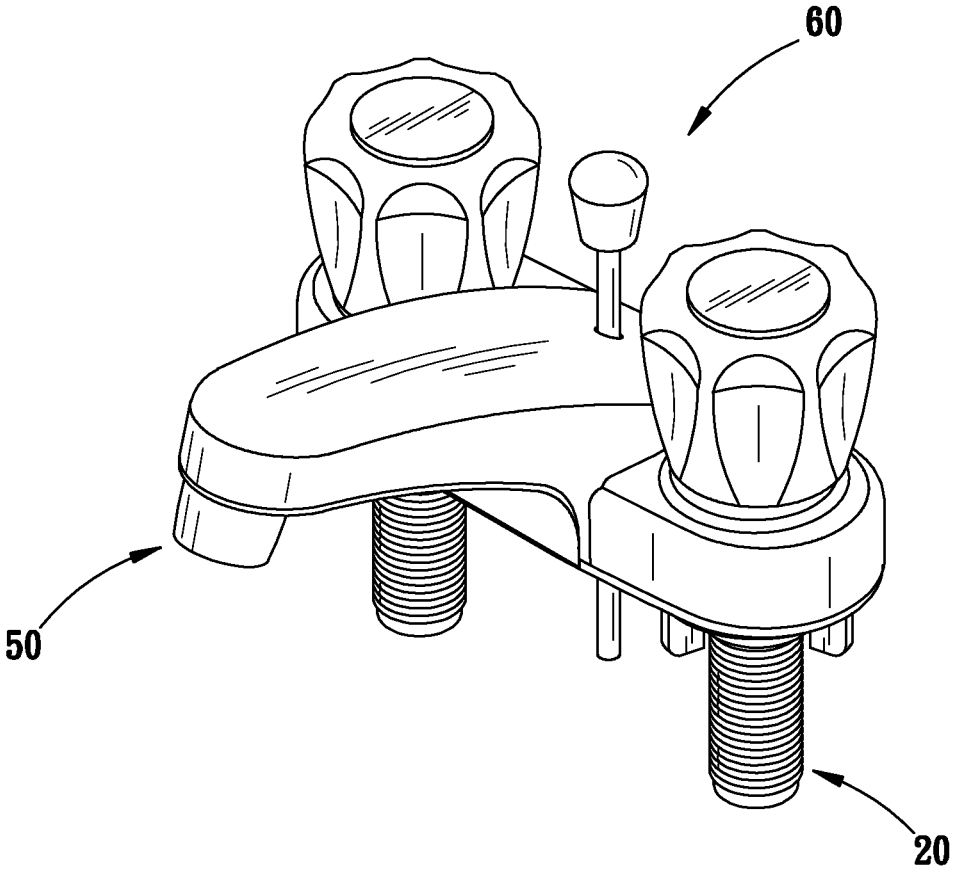
FIG. 12 is a perspective view of an assembled faucet including the inlet pipe of FIG. 11.

In one example, FIG. 11 and FIG. 12 depict the assembly of the one embodiment of the invention. The inlet pipe 20 is connected with a control valve 30, an outlet pipe 40 of a faucet outlet 50 and a first face plate 60 of a first handle for form a faucet assembly. This assembly is characterized by connecting a set of connecting pipes 41 of the outlet pipe 40 to the pipe section 216 of the inlet pipe 20 so as to provide a hot-cold water output. For example, one of the connecting pipes 41 is connected to the inlet pipe 20 that is connected to a hot water source, while the other connecting pipe 41 is connected to another inlet pipe 20 that is connected to a cold water source. The outlet pipe 40 includes a joining pipe 42 which is slightly angled on a plane/axis relative to a line established by the connecting pipes 41. The joining pipe 42 is connected to the faucet outlet 50. The faucet outlet 50 includes a number of protruding strengthening ribs 51 disposed at an outer surface of the faucet outlet 50. In addition, the faucet outlet 50 also includes an "M" shaped limiting slit 52 on each side of the faucet outlet 50. The outlet pipe 40 includes one or more sealing rings 411 on the openings of each of the connecting pipes 41 to achieve the optimal water leakage or water seepage prevention effect. The first face plate 60 is connected to the outlet pipe 20 by engaging an external threaded section 217 of the outlet pipe 20, as well as the outlet pipe 40 to form a faucet. The first face plate 60 includes two screw openings 62 and the limiting slits 52 of the faucet outlet 50 are fastened to the screw openings 62 using locking units 63. The locking units 63 stabilize the first face plate 60 to the faucet outlet 50 and to strengthen resistance from water pressure as water exits the faucet outlet 50. This assembly, with the configuration of the inlet pipe 20, provides a fast assembly and is not time-consuming and avoids prior assembly approaches of faucets, valves and inlet pipes.

Figure 13:
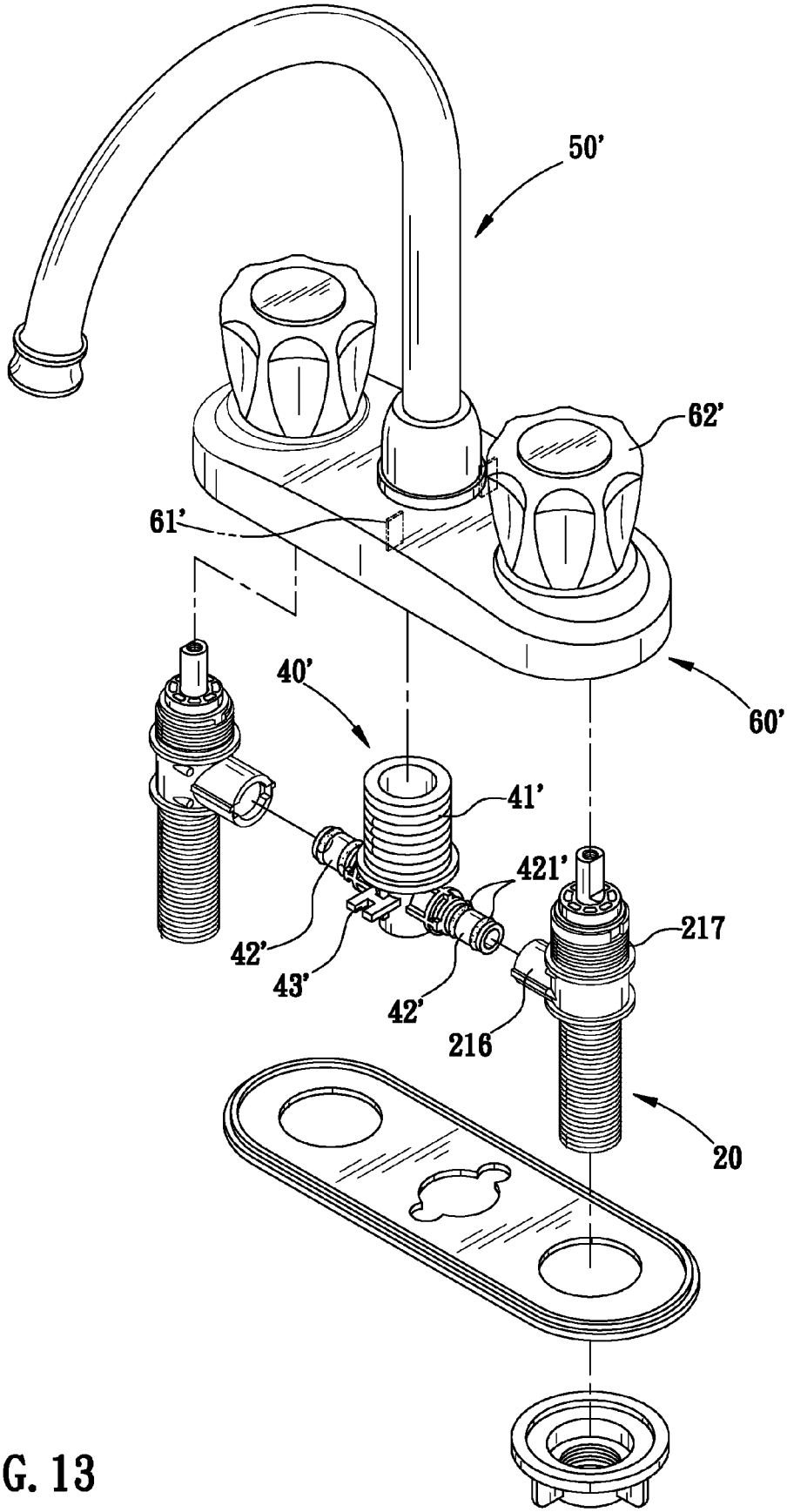
FIG. 13 is a perspective exploding view of the inlet pipe in an assembly according to second embodiment of the invention.
Figure 14:
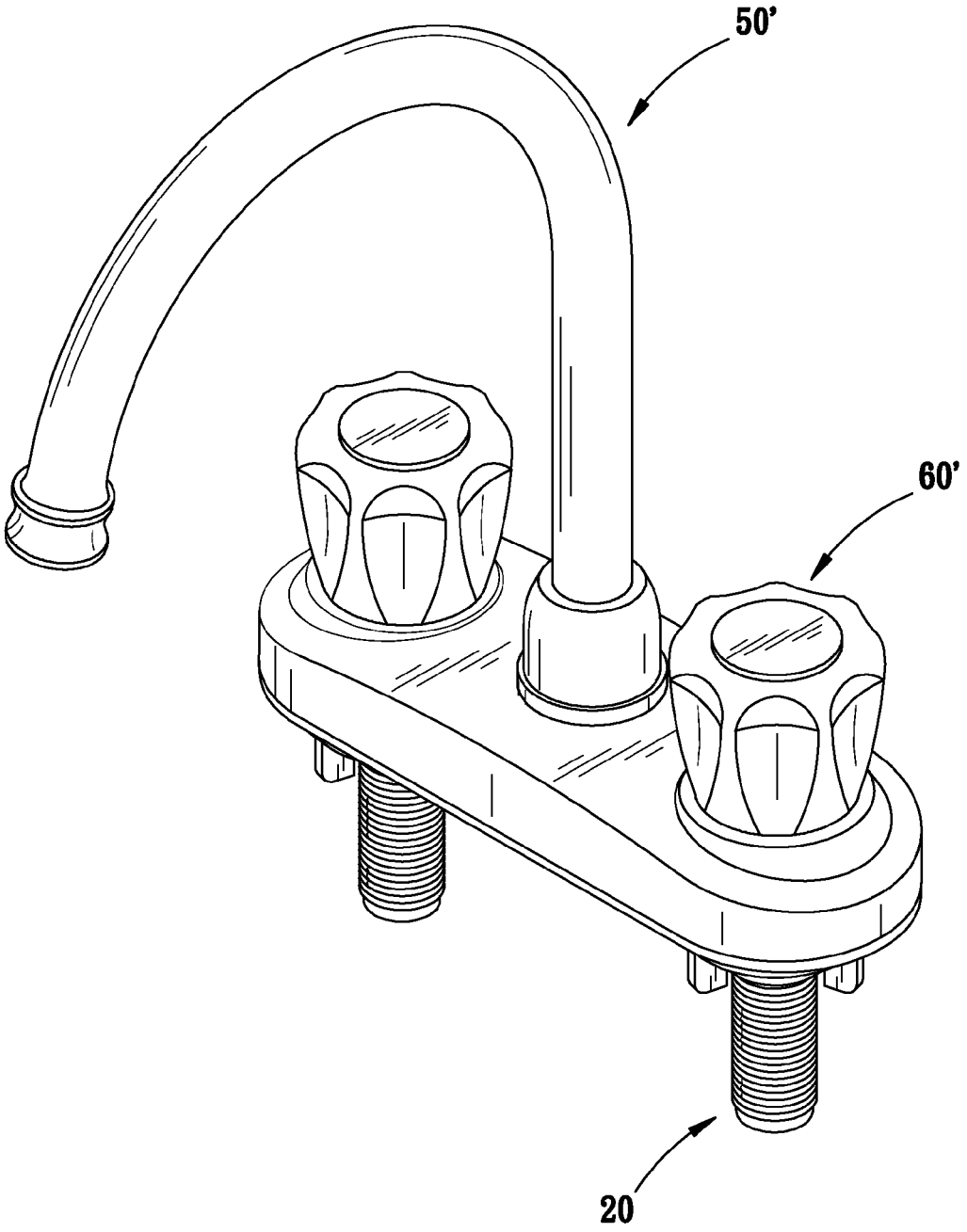
FIG. 14 is a perspective view of an assembled faucet including the inlet pipe of FIG. 13.

Referring to FIG. 13 and FIG. 14, this embodiment's outlet pipe 40' includes a lock connection section 41' at the top of the outlet pipe 40. At each end of a set of connecting pipes 42', this embodiment includes one or more sealing rings 421'. The connecting pipes 42' are connected with the pipe section 216 of the inlet pipe 20. On the perpendicular side relative to the connecting pipes 42', this embodiment includes a set of "M" shaped limiting slits 43', which is set to receive a correspondingly positioned limiting pieces 61' of the face plate 60'. The external threaded section 217 of the inlet pipe 20 is fastened to the lock connecting section 41' of the outlet pipe 40'. In addition, a handle 62' and a faucet outlet 50' are connected with the above to form a faucet, which reinforces the faceplate 60' and the inlet pipe 20 in the final assembly to resist water pressure as water exits the faucet outlet 50'.

Figure 15:
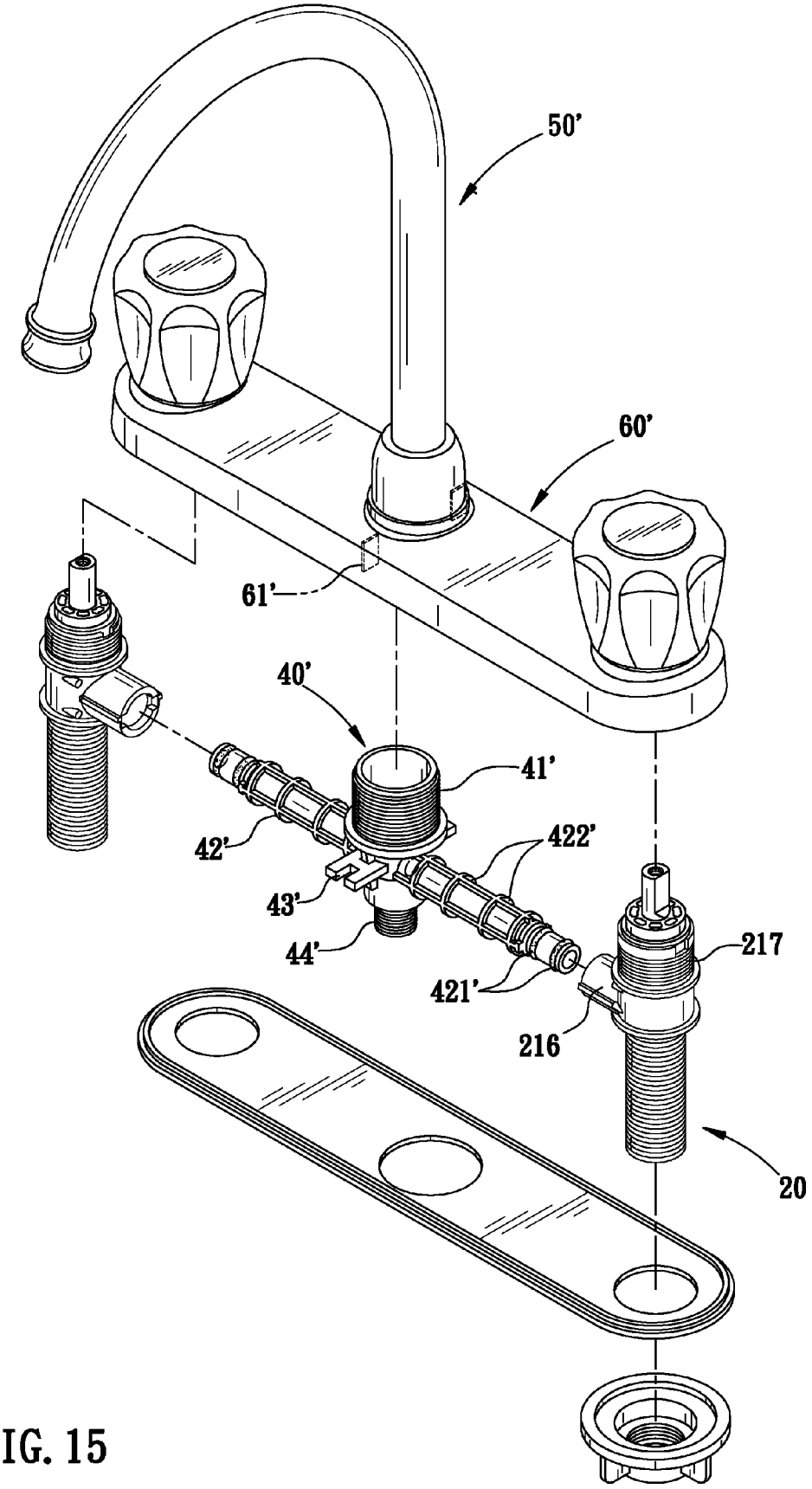
FIG. 15 is a perspective exploding view of the inlet pipe in an assembly according to third embodiment of the invention.
Figure 16:
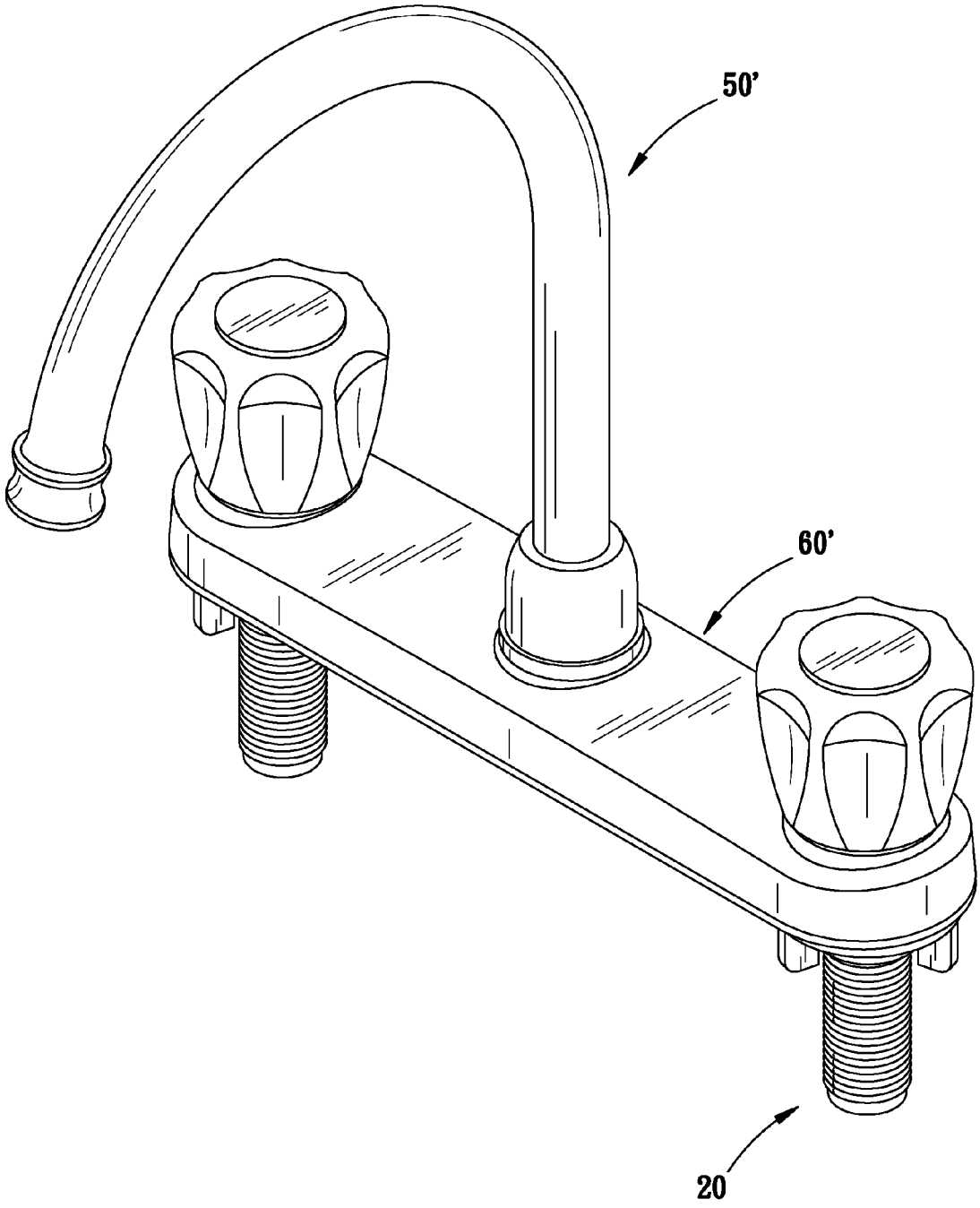
FIG. 16 is a perspective view of an assembled faucet including the inlet pipe of FIG. 15.

As further shown in FIG. 15 and FIG. 16, a set of connecting pipes 42' of an outlet pipe 40' may fit into a face plate 60' of varying sizes, such as extending the length of the connecting pipes 42' to be connected with the pipe section 216 of the inlet pipe 20 to form an assembly of a final product. In addition, the connecting pipes 42' include one or more horizontal and/or circular/ring-shaped strengthening ribs to increase an overall strength and stability thereof. In addition, the outlet pipe 40' includes an outlet end 44' at a distal end of the outlet pipe 40' to connect additional outlets, such as a hose or a spraying gun.

Figure 17:
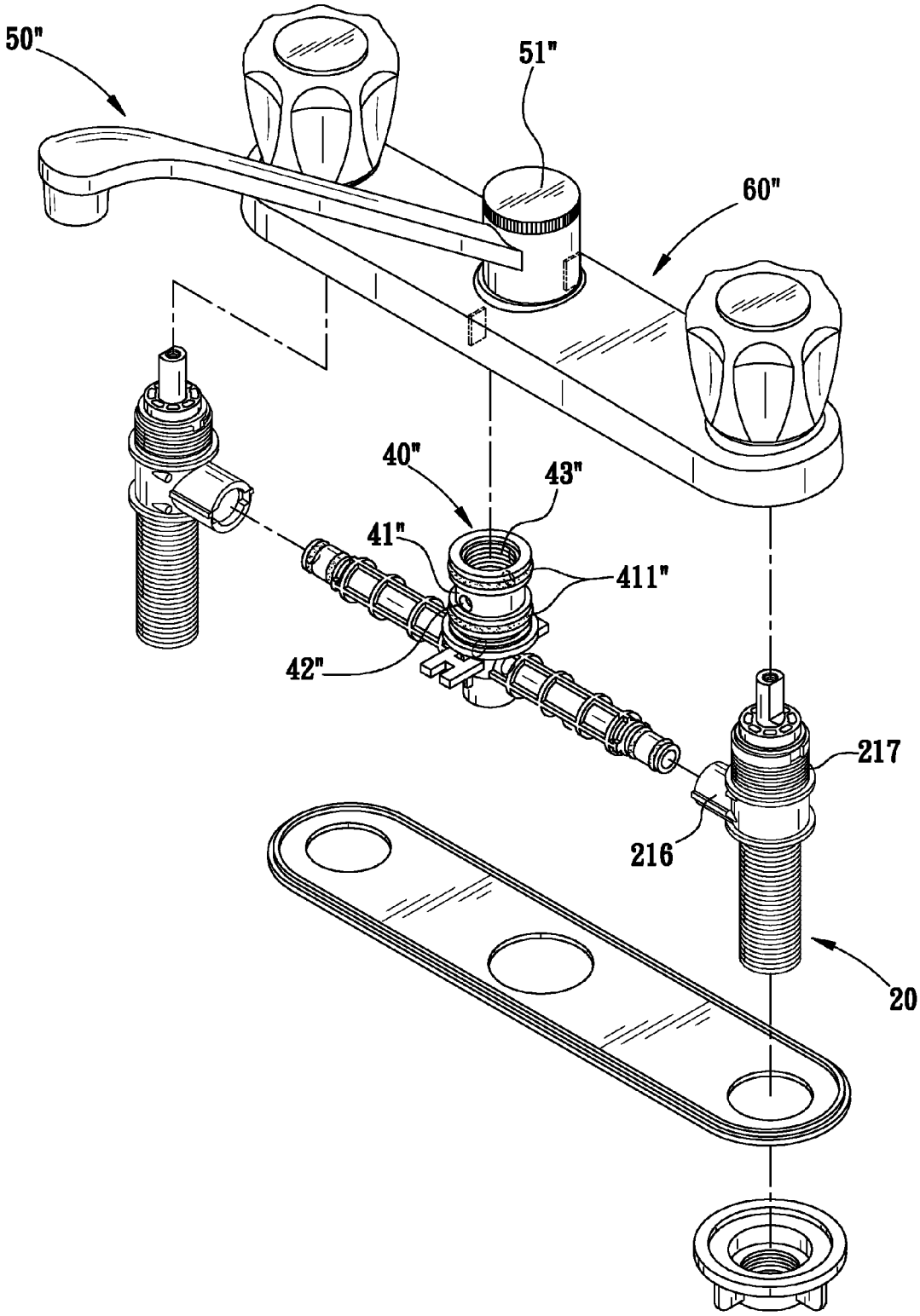
FIG. 17 is a perspective exploding view of the inlet pipe in an assembly according to fourth embodiment of the invention.
Figure 18:
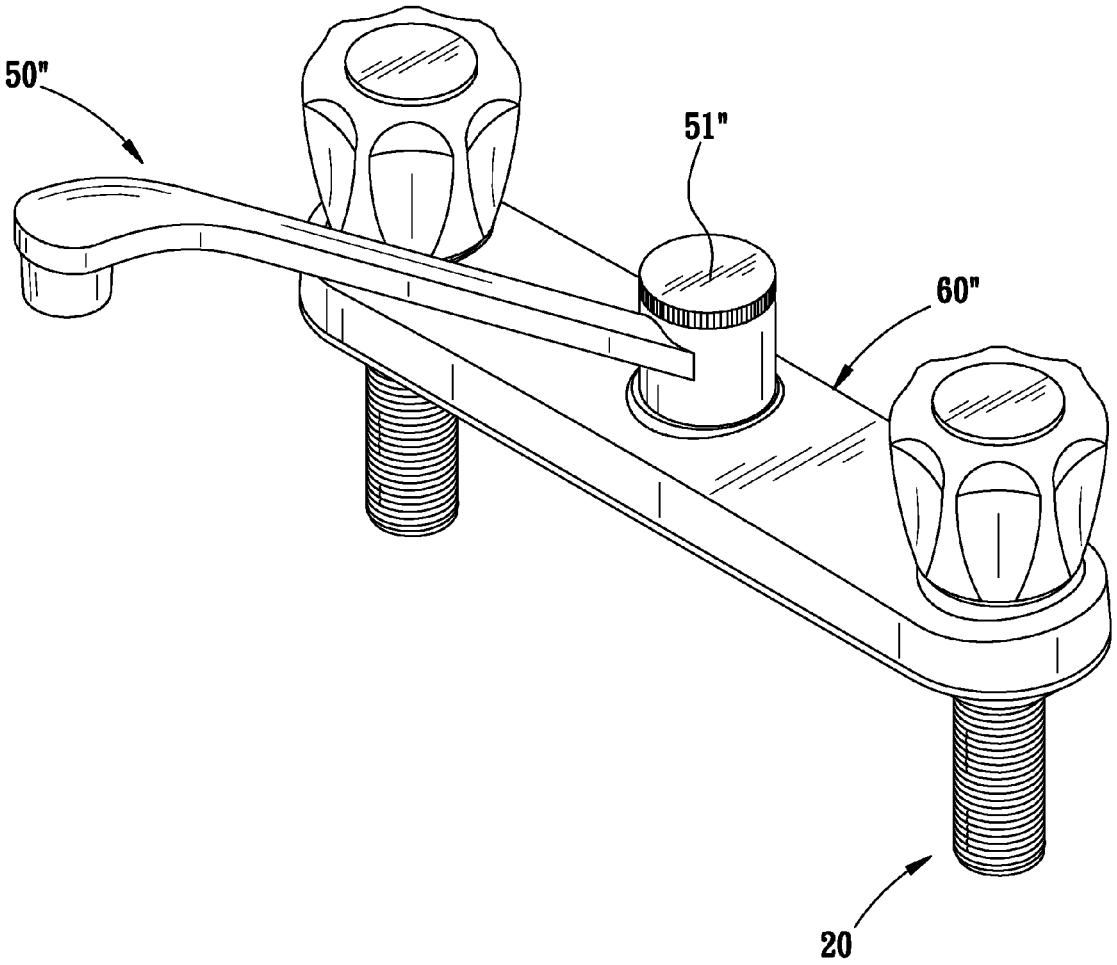
FIG. 18 is a perspective view of an assembled faucet including the inlet pipe of FIG. 17.

Also, as shown in FIG. 17 and FIG. 18, this embodiment's outlet pipe 40" includes about two sealing rings 411" at a distal end of the outlet pipe 40". The outlet pipe 40" also includes a ring groove 41" and the outlet pipe 40" includes an internal threaded section 43" on the inner wall of the outlet pipe 40". The ring threaded 41" includes an opening 42". A third face plate 60" includes a cap 51" which has a faucet outlet 50". The cap 51" and the faucet outlet 50" are engaged with the ring threaded 41" and the opening 42" such that the sealing rings 411" of the ring threaded 41" come in close contact or closely biased against the inner wall of the faucet outlet 50" and the cap 51" as well as fastened to the outlet pipe 40" through the internal threaded section 43". This configuration can achieve assembly and water-leakage or water-seepage prevention purposes. At the same time, the opening 42"

and the faucet outlet 50" are interconnected so that the water can exit from the faucet outlet 50".

Figure 19:
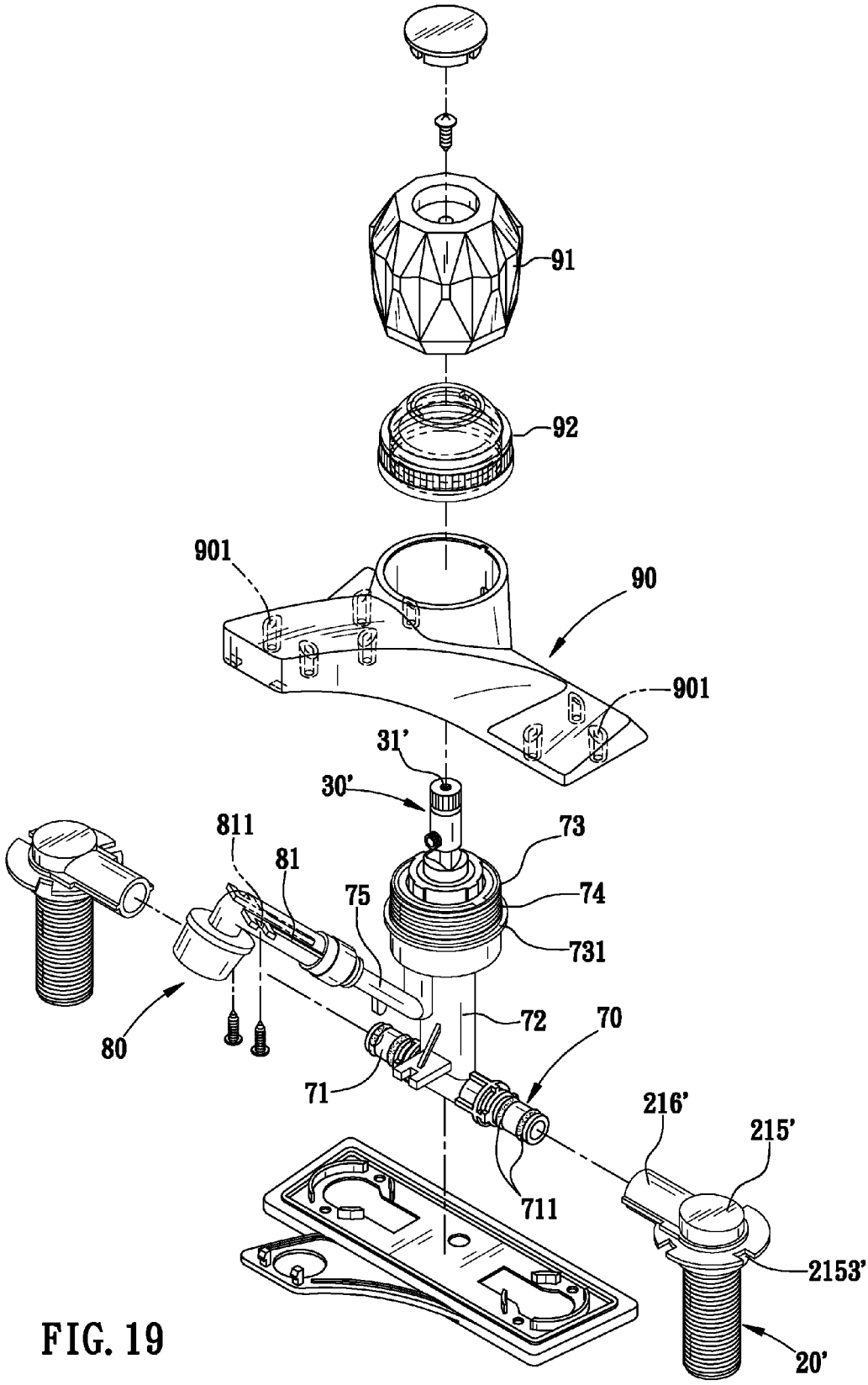
FIG. 19 is a perspective exploding view of the inlet pipe in an assembly according to a further embodiment of the invention.
Figure 20:
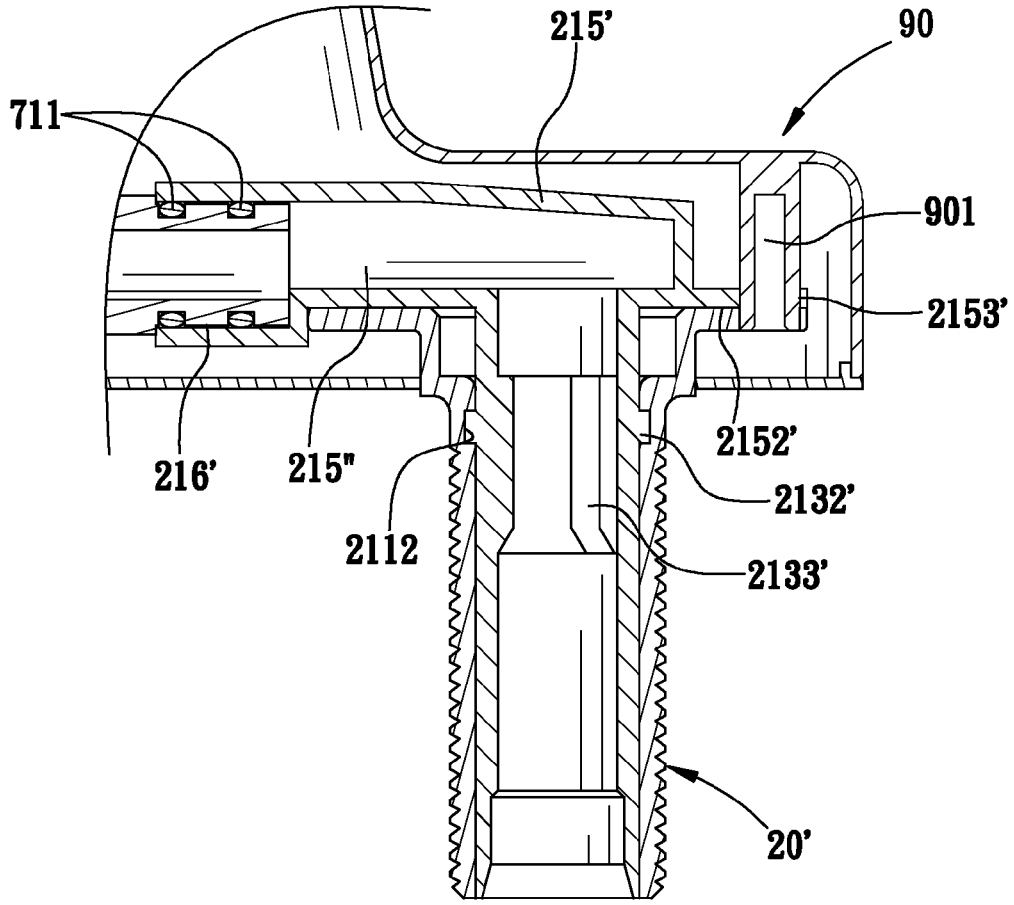
FIG. 20 is a cross-section view of a part of an assembled faucet including the inlet pipe of FIG. 19.
Figure 21:
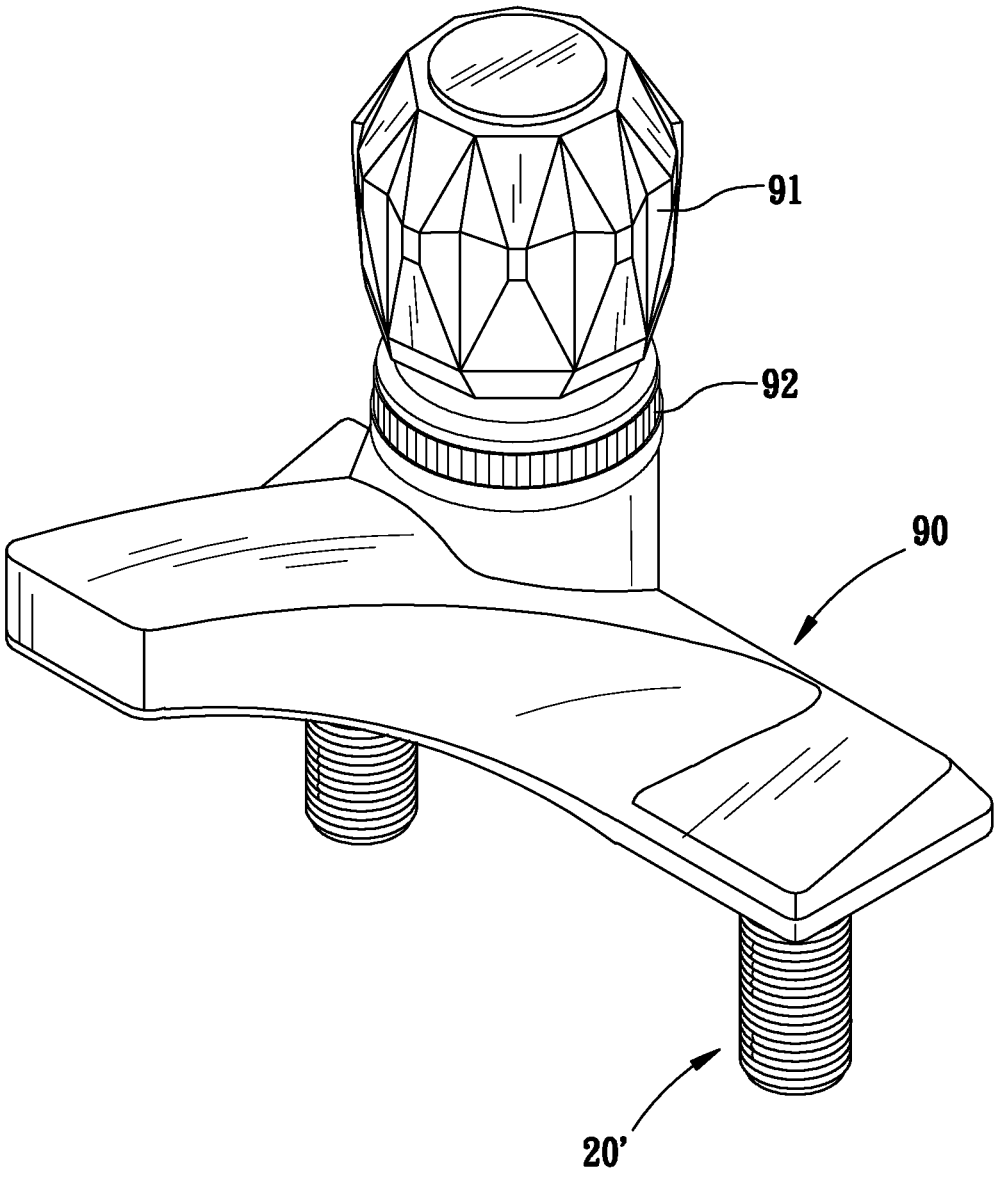
FIG. 21 is a perspective view of the assembled faucet including the inlet pipe of FIG. 19.

According to FIGS. 19 through 21, the inlet pipe 21', an outlet connecting pipe 70, an outlet pipe 80, a handle 91, a locking cover 92, and a face plate 90 form an assembly. The outlet connecting pipe 70 includes a set of connecting pipes 71, which are connected to the pipe section 216' of the inlet pipe 20' to transport hot water and cold water. The connecting pipes 71 include a set of sealing rings 711 at appropriate locations on the connecting pipes 71. The outlet connecting pipe 70 also includes a pipe section 72 extending in a vertical direction and a receiving chamber 73. The receiving chamber 73 is configured to have a diameter that is larger than that of the pipe section 72. The receiving chamber 73 also provides a housing for a control valve 31'. The receiving chamber 73 includes a stopping ring 731, and the stopping ring 731 includes an externally threaded section 74. The receiving chamber 73 also disposed at the bottom end a connecting section 75 in a shape of "V" to be joined with the outlet pipe 80. The outlet pipe 80's surface includes a set of strengthening ribs 81 that is in the shape of capitalized alphabet "F" with the long edge of the ribs fixed on the outlet pipe 80 in a parallel plane. The limiting slits 811 created by ribs 81 through the "F" shape further increase the strength integrity of the outlet pipe 80. During assembly, the lock cover 92 and the handle of the face plate 90 are connected with and tightened to the external threaded section 74 of the receiving chamber 73 and a rotating axle 31' of the control valve 30'. The face plate 90 may include one or more limiting pieces 901 to be biased against the first limiting slits 2153' of the inlet pipe 20' and the limiting slits 811 of the outlet pipe 80. By doing so, theses pieces are locked in place or limited in its movements to form an assembly for hot-water-cold-water faucet.

Figure 22:
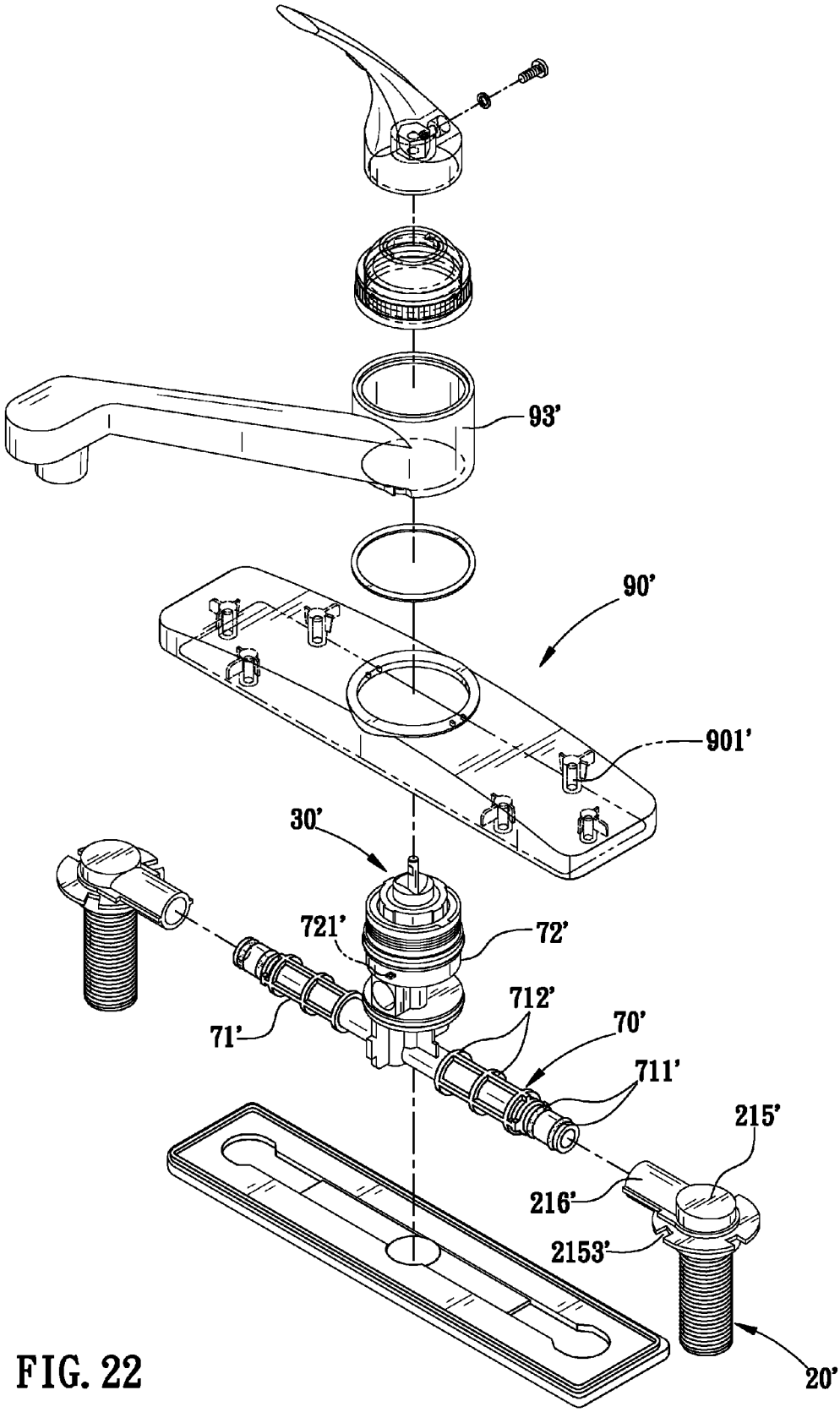
FIG. 22 is a perspective exploding view of the inlet pipe in an assembly according to a second further embodiment of the invention.
Figure 23:
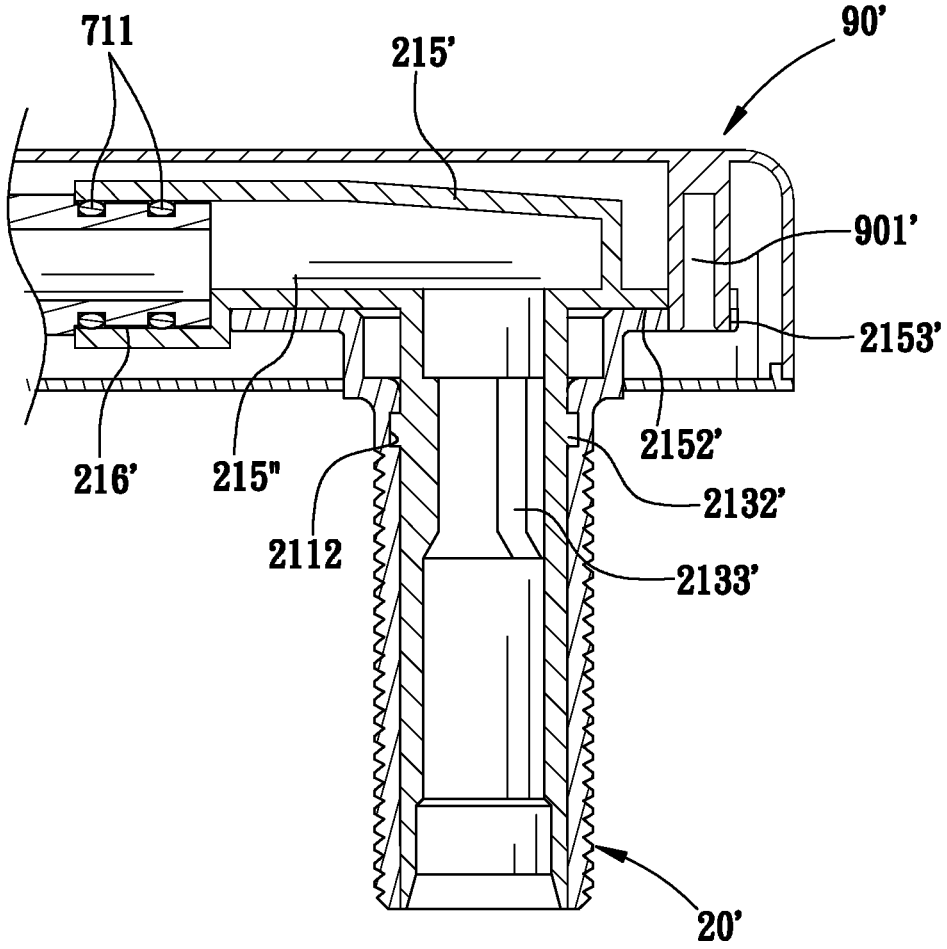
FIG. 23 is a cross-section view of a part of an assembled faucet including the inlet pipe of FIG. 22.
Figure 24:
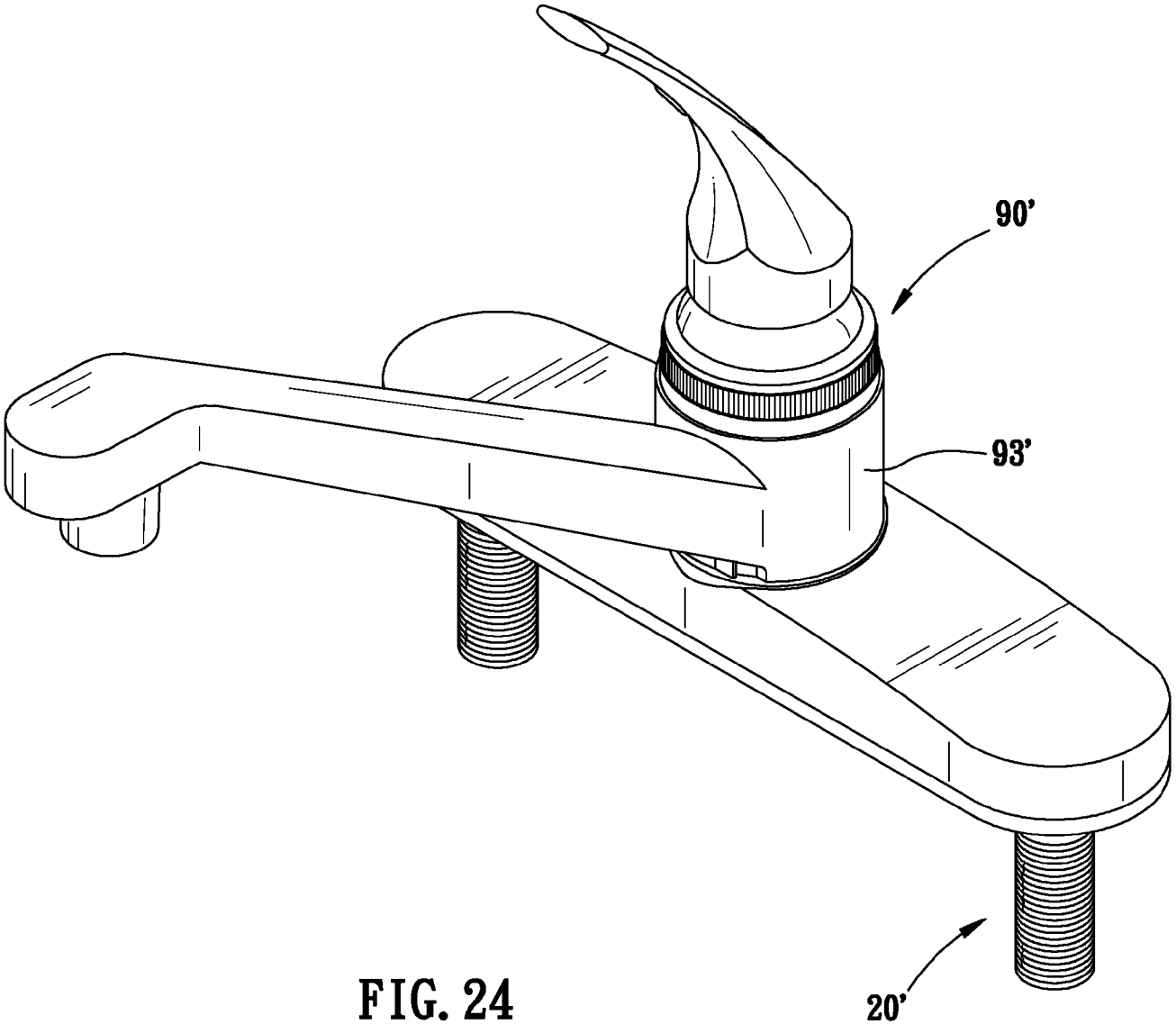
FIG. 24 is a perspective view of the assembled faucet including the inlet pipe of FIG. 22.

According to FIGS. 22 to 24, an outlet connecting pipe 70' includes a set of connecting pipes 71' in order to fit or accommodate a face plate 90' of different lengths and sizes before connecting to the pipe section 216' of the inlet pipe 20'. Also, the connecting pipes 71' include one or more fifth strengthening ribs 712' that may be in a ring/disc shape or in lines or a combination thereof. The connecting pipes 71 further include sealing rings 711'. The strengthening ribs 712' and the sealing rings 711' further improve the overall strength and leak-proof capability of the connecting pipes 71'. The outlet connecting pipe 70' also includes a receiving chamber 72' at the top thereof to house a control valve 30'. The receiving chamber 72' includes a pre-set opening 721' and the opening 721' corresponds to an outlet 93' of the face plate 90' to enable exiting of water. In addition, the face plate 90' includes one or more limiting ribs 901' at the bottom surface thereof. These ribs 901' are fitted to the first limiting slit 2153' of the inlet pipe 20' to achieve limiting the movements of the face plate 90'.

In practice, one embodiment of the invention includes an improved hot-cold water inlet pipe that includes an inlet pipe, said inlet pipe including a metallic threaded external pipe, said metallic threaded external pipe setting a locking ring with one or more slits, said ring having a smaller diameter than that of the external pipe. The embodiment also includes an internal pipe for engaging with an interior of the metallic threaded external pipe for strengthening said metallic threaded external pipe, said internal pipe being composed of a non-toxic plastic material with weather-resistant and pressure-resistant properties. The embodiment also includes a connecting section extending the interior of the metallic threaded external pipe for enclosing the one or more slits in one unit, and a receiving chamber, being disposed at a distal end of the internal pipe, includes external threads thereon, said receiving chamber including a top opening and a bottom opening, said bottom opening having a diameter smaller than that of the internal pipe and connecting to the internal pipe, said top opening of the receiving chamber including one or more locking slits to cooperatively fit with a control valve, wherein the connection section completely encloses the receiving chamber.

In another embodiment, an improved hot-cold water inlet pipe includes an inlet pipe, and the inlet pipe includes a metallic threaded external pipe. The metallic threaded external pipe sets a locking ring with one or more slits, said ring having a smaller diameter than that of the external pipe. An internal pipe for engaging with an interior of the metallic threaded external pipe for strengthening said metallic threaded external pipe, said internal pipe being composed of a non-toxic plastic material with weather-resistant and pressure-resistant properties. A connecting section extending the interior of the metallic threaded external pipe for enclosing the one or more slits in one unit, said connecting section including a cap having a diameter that is larger than that of the inlet pipe and forms a water-receiving area. A stopping ring on an exterior of the cap, said stopping ring having a larger diameter than that of the cap. A pipe section including a first strengthening rib disposed at an exterior surface of the pipe section near an opening thereof to assist the strengthen integrity of the pipe section and prevent water from contact the metallic threaded external pipe.

Although the invention has been explained in relation to its various embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

Having described the invention in detail, it will be apparent that modifications and variations are possible without departing from the scope of the invention defined in the appended claims.

When introducing elements of the embodiments(s) of the present invention, the articles "a", "an", the and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above constructions or products without departing from the scope of the invention, it is intended that all matter contained in the above description and shown in the accompanying drawing(s) shall be interpreted as illustrative and not in a limiting sense.

What is claimed is:

1. An improved hot-cold water inlet pipe comprising:

an inlet pipe, said inlet pipe including a metallic threaded external pipe, said metallic threaded external pipe including a locking ring with one or more slits, said ring having a smaller diameter than that of the external pipe;

an internal pipe for engaging with an interior of the metallic threaded external pipe for strengthening said metallic threaded external pipe, said internal pipe being composed of a non-toxic plastic material with weather-resistant and pressure-resistant properties;

a connecting section connecting the interior of the metallic threaded external pipe and enclosing the one or more slits as one unit; and a receiving chamber, being disposed at a distal end of the internal pipe, includes external threads thereon, said receiving chamber including a top opening and a bottom opening, said bottom opening having a diameter smaller than that of the internal pipe and connecting to the internal pipe, said top opening of the receiving chamber including one or more locking slits to cooperatively fit with a control valve, wherein said connection section completely encloses the receiving chamber.

2. The improved hot-cold water inlet pipe of claim 1, wherein the locking ring of the inlet pipe disposed off-center of the receiving chamber and is cooperating with the control valve via a blocking ring disposed at one end of the locking ring.

3. The improved hot-cold water inlet pipe of claim 1, wherein the receiving chamber comprises a first stopping ring and a second stopping ring spaced apart at an outer surface thereof.

4. The improved hot-cold water inlet pipe of claim 1, wherein the locking ring comprises a shape of a "reverse L".

5. The improved hot-cold water inlet pipe of claim 1, wherein the one or more slits of the locking ring are sealed.

6. The improved hot-cold water inlet pipe of claim 1, wherein the pipe section comprises one or more strengthening ribs protruding from a surface of the pipe section to improve strength of the pipe section, said one pipe section being connected to an outlet pipe.

7. The improved hot-cold water inlet pipe of claim 1, wherein the internal pipe comprises a corner at a slanted angle.

* * * * *